United States Patent [19]

Turner

[11] 4,114,053

[45] Sep. 12, 1978

[54] ZERO TEMPERATURE COEFFICIENT REFERENCE CIRCUIT

[75] Inventor: Robert B. Turner, Weymouth, Mass.

[73] Assignee: Johnson & Johnson, New Brunswick, N.J.

[21] Appl. No.: 758,629

[22] Filed: Jan. 12, 1977

[51] Int. Cl.[2] ..... H01V 3/00; G05F 3/00

[52] U.S. Cl. ..... 307/310; 307/297; 323/39; 323/68

[58] Field of Search ..... 307/310, 296, 297; 330/19, 22, 23; 323/22 T, 39, 68

[56] References Cited

U.S. PATENT DOCUMENTS

| | | | |
|---|---|---|---|
| 3,659,121 | 4/1972 | Frederiksen | 330/22 |
| 3,831,040 | 9/1974 | Nanba et al. | 307/297 |
| 3,906,386 | 9/1975 | Hongu et al. | 330/19 |
| 3,992,676 | 11/1976 | Knight | 330/19 |

*Primary Examiner*—Stanley D. Miller, Jr.
*Assistant Examiner*—B. P. Davis

[57] ABSTRACT

A temperature insensitive voltage reference circuit for use between a voltage supply and an amplifier or comparator reference input is provided having a very small overall temperature coefficient value, approaching zero, over a wide operating range for stabilizing reference voltage with temperature. Preferably, a transistor is connected emitter to ground with its collector designated the circuit output to the reference input. An adjustable voltage divider may be connected between the voltage supply and the circuit output with the intermediate point connected to the base of the transistor.

3 Claims, 2 Drawing Figures

ZERO TEMPERATURE COEFFICIENT REFERENCE CIRCUIT

BACKGROUND OF THE INVENTION

Reference voltage circuits for use between a voltage supply and an input terminal to a reference amplifier or comparator have in the past included temperature compensating components or circuits. Most commonly the voltage supply is connected to a diode tied to ground through a resistor. The diode is oriented with its bias to pass current to ground. With this circuit, the diode side of the supply resistor becomes the voltage output terminal which is connected to an input terminal of the reference amplifier or comparator. The .6V voltage drop across the diode provides a relatively stable reference voltage into the amplifier.

The problem with this circuit, however, is that the reference voltage supplied to the input terminal of the amplifier or comparator while being tied down or limited by the diode does in fact drift because of the temperature coefficient of the diode. Norminally, this drift may be as much as 3 millivolts per degree centigrade.

One engineering approach which compensates for the temperature coefficient of the diode is the use of two closely matched diodes connected in series to ground. The purpose is to create a voltage divider with the diodes and to rely upon the diodes drifting in a similar manner with temperature. If this occurs, the ratio will be maintained which ultimately presents the same voltage value to the amplifier. However, such diode pairing becomes quite expensive and is cost prohibitive in many circuits.

An equivalent circuit to the dual diode approach above is a single transistor which has been connected to act as the two closely matched diodes. In this circuit, the collector-base junction forms one diode and the base-emitter junction forms the other. A single transistor has, thusly, been connected with its collector and base terminals tied together and its emitter terminal tied to ground. For this circuit, a voltage supply is tied to the collector through a current limiting supply resistor and the collector is designated the output terminal of the circuit. However, as with the previous circuit, the selection of an appropriate transistor having closely matched collector-base and base-emitter diode junctions with matched temperature coefficients becomes expensive. Moreover, even with the most selectively chosen transistors, temperature drift still occurs in the range of 200 to 300 parts per million or 0.02 to 0.03% change over the operating temperature range.

An object of this invention, therefore, is to provide a temperature reference circuit having a very low overall temperature coefficient, approaching zero temperature coefficient.

A second object of this invention is to provide such a circuit which may be constructed of inexpensive and readily available components.

A further object is to provide this zero temperature coefficient reference circuit using inexpensive components wherein temperature compensation is provided to counteract and nullify the effect of the normal temperature drift in the inexpensive components.

SUMMARY OF THE INVENTION

The objectives of this invention are achieved by an ambient temperature insensitive reference circuit connectable between a voltage supply and the input to a reference amplifier or comparator wherein a semiconductor device such as an NPN transistor may be connected to utilize its effective diode characteristic junctions as a dual-diode series circuit to ground in order to tie down or regulate the connection point between the voltage supply and a reference input terminal of such an amplifier and comparator to a voltage value stable with variations in ambient temperature.

Connected in series with the voltage supply may be a fixed supply resistor. The transistor base terminal may be connected to this resistor. A variable resistor may connect the collector terminal to the base terminal of the transistor. The collector terminal of the transistor may be designated the output terminal of the circuit which is connectable to the reference input terminal of an amplifier or comparator.

The variable resistor may be adjusted to compensate for the normal temperature drift of the transistor. A resistance ratio of the variable resistor to the fixed resistor adjusts the current flow between the transistor collector and base terminals which in turn bears on the temperature coefficient of the entire circuit. Proper adjustment of the variable resistor may provide a very low temperature coefficient for the circuit and in fact a temperature coefficient which is nominally zero to yield a circuit insensitive to ambient temperature.

DETAILED DESCRIPTION OF THE DRAWINGS

Figure 1:
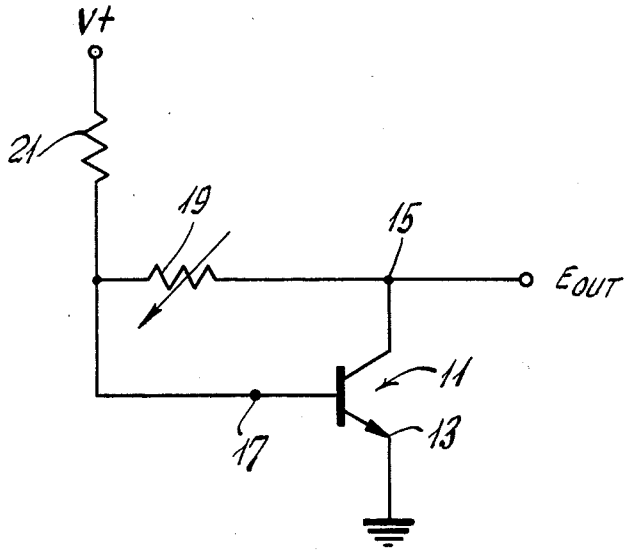
Figure 2:
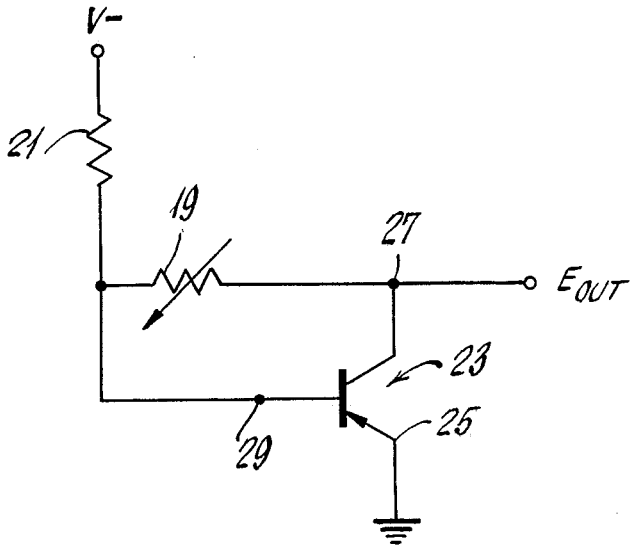

The various advantages and features of this invention will become readily apparent from the following detailed description and accompanying drawings FIGS. 1 and 2 which show an electrical schematic of the circuit comprising the invention using an NPN transistor and a PNP transistor respectively and in which like numerals refer to like elements.

A zero temperature coefficient voltage reference circuit may be constructed as shown in the accompanying drawings. Such a circuit will provide a regulated reference voltage which is stable with changes in ambient temperature.

The electric circuit characteristics of various circuit components change with changes in ambient temperature depending upon the quality of the component. Transistor characteristics, diode characteristics and resistor characteristics change with ambient temperature. This propensity to change is called "temperature coefficient" (Tc). For any component it is given in units of change per degrees centigrade above or below nominal operating temperature. Any circuit component can be assigned a numerical value describing this change in characteristic. Many temperature coefficients (Tc) are given a plus value meaning the particular characteristic value increases with an increase in ambient temperature (directly proportional). However, it is not uncommon for circuit components to have a negative temperature coefficient which means that the characteristic value decreases with an increase in temperature (inversely proportional).

A commonly available NPN transistor 11 such as type 2N4274, FIG. 1, can be connected with its emitter terminal 13 tied to ground and its collector terminal 15 tied to its base terminal 17 through a variable resistor 19. The base terminal 17 is connected to a positive voltage supply V+ via a fixed resistor 21. The resistor 21 limits the current supplied by V+. The collector terminal 15 is designated the output, Eo, of the circuit to be tied to the input of an amplifier or a comparator.

Nominally the voltage drop across the collector to base junction and the base to emitter junction is 0.6 to 0.7 volts. Variations occur from individual transistor to individual transistor and from junction to junction within a particular transistor. Because in the less expensive transistors the doping process is not as exact, the temperature coefficient (Tc) of the individual "diode effect" junctions (collector-base and base-emitter) in these less expensive transistors can vary, i.e., the voltage drop across each junction does not change equally with changes in ambient temperature. Therefore, with these transistors the Tc of the collector-base junction is most often different from the Tc of the base-emitter junction. Voltage regulation is, therefore, lost with changes in ambient temperature. In such an inexpensive transistor the temperature coefficient for the two "diode effect" junctions can vary as much as 1–2 millivolts per degree centigrade.

With variable resistor 19 connecting the transistor 11 collector 15 to base 17, it regulates or limits the amount of current flowing across the collector-base junction of the transistor 11. By adjusting resistor 19, the effective temperature coefficient of the transistor 11 collector-base junction may be matched to the base-emitter junction. The resistors 19, 21 form a sort of voltage divider with the intermediate tap connected to the base 17 of the transistor 11. The resistance ratio of resistor 19 to resistor 21 bears upon the current flowing in the circuit across the collector-base junction and across the base-emitter junction which in turn bears on the effective overall temperature coefficient for the circuit.

When the value of the collector to base resistor 19 exceeds the supply resistor 21, the effective overall temperature coefficient for the circuit has a plus value. That is to say, output voltage at the transistor collector 11 will increase with an increase in ambient temperature. As the value of the collector to base resistor 19 is adjusted lower so this resistor 19 value is less than the supply voltage resistor 21 value, the positive temperature coefficient begins to decrease, linearly, through a zero point and becomes a negative temperature coefficient where the voltage out for the whole circuit decreases with an increase in ambient temperature.

A typical value for the supply resistor 21 is 56 K ohms. When a commonly available transistor such as the 2N4274 mentioned above having a positive temperature coefficient, is used in the circuit, zero temperature coefficient is obtained for the overall circuit when the collector to base resistor 19 has an adjusted value of approximately 0.20 times the value of the supply resistor 21. With the supply resistor 21 having a value of 56 K ohms, zero temperature coefficient is reached with the collector to emitter resistor 19 having a value of approximately 12 K ohms.

In establishing a zero temperature coefficient for the circuit the temperature coefficient of the two individual resistors 19, 21 may also be considered. When designing microelectronic circuits which use thick film resistors the temperature coefficient of the resistors may usually be specified. Moreover, thick film resistors are very often available with either a plus or a minus temperature coefficient assigned to them without increasing their cost. Ideally, it is desirable that resistors 19, 21 have matching temperature coefficients in order that their delta coefficients track together with temperature. The supply resistor 21 in FIG. 1, therefore, can be a thick film resistor with a temperature coefficient equal to approximately 19 for a nominal ohmic value of 56 K ohms. By choosing a thick film trimmable resistor for the collector to emitter resistor 19 the resistance 19 can be trimmed to increase the ohmic value of resistor 19 which results in an overall negative going temperature coefficient value, i.e., a less positive temperature coefficient.

The subject invention, as described above, may be implemented in microcircuitry using trimmable thick film resistors for both the collector to emitter resistance 19 and the supply resistance 21. In this instance, resistor 21 is first trimmed to set the reference voltage and then resistance 19 is trimmed to obtain an overall zero temperature coefficient for the whole circuit.

When constructing this circuit, all of the components should first be burned-in at a test temperature substantially above operating temperature. The circuit should then be assembled and the resistors 21 and 19 trimmed to give a zero temperature coefficient. Because of the constant temperature coefficient value attributable to semiconductor material, only two test temperature points need be established to define a zero temperature coefficient. A nominally zero temperature coefficient can thusly be established for the regulated voltage reference circuit for an operating range of 0° to +55° C.

When a negative reference voltage is needed the embodiment as shown in FIG. 2 is used. A PNP transistor 23 is connected with its emitter terminal 25 to ground and collector terminal 27 connected to its base terminal 29 through a variable resistor 19. The base terminal 29 is connected to a negative voltage supply V− via a fixed resistor 21. The resistor 21 limits the current supplied by V−. The ratio of resistor 19 to resistor 21 affects the temperature coefficient of the circuit. The collector terminal 27 is designated the output, Eo, of the circuit which can be connected to an input of an amplifier or other circuit component.

The circuit descriptions given above can be varied to present other embodiments without departing from the scope of the invention. As an example, a diode pair could be substituted for the transistor 11. Other current limiting means could be substituted for the resistors 19, 21. It is intended that the circuit descriptions be taken in an illustrative sense and not in a limiting sense.

What is claimed is:

1. A voltage regulation circuit having an input and an output and being temperature stable to provide a nominally zero temperature coefficient, for use in connection with a voltage supply to provide a temperature stable regulated voltage, comprising:

a transistor connected with its emitter to ground and its collector to the circuit output said transistor having individual and different temperature coefficients for its collector-base and base-emitter junctions;

a voltage divider being connected between said voltage supply and said collector of said transistor with its intermediate tap being connected to said base of said transistor, said voltage divider ratio establishing the overall circuit temperature coefficient at nominal zero;

wherein said voltage divider includes a first resistor connected to said voltage supply and a second resistor connected between said first resistor and said collector of said transistor, the interconnection point of said first and second resistors being connected to said base of said transistor, the relationship between the value of said second resistor and said first resistor being to provide an overall circuit temperature coefficient of nominally zero;

wherein said second resistor is a variable resistance, said first resistor being selected at a predetermined nominal value and said second resistor then being adjusted to be substantially 20% of said nominal value.

2. The circuit of claim 1 wherein said first resistance is approximately a 56K ohm resistor, wherein said variable resistance has its value set at approximately 12 K ohms and wherein said transistor is of a type similar to a 2N4274.

3. The circuit of claim 2 wherein said first and second resistors each are of thick film trimmable resistance components.

* * * * *

UNITED STATES PATENT AND TRADEMARK OFFICE

CERTIFICATE OF CORRECTION

PATENT NO. : 4,114,053

DATED : September 12, 1978

INVENTOR(S) : Robert B. Turner

It is certified that error appears in the above-identified patent and that said Letters Patent are hereby corrected as shown below:

In Column 1, line 22, "Norminally," should read ---Nominally,---

Signed and Sealed this

*Fifth* Day of *June 1979*

[SEAL]

*Attest:*

RUTH C. MASON
*Attesting Officer*

DONALD W. BANNER
*Commissioner of Patents and Trademarks*